US008043442B2

(12) United States Patent
Haeberle

(10) Patent No.: US 8,043,442 B2
(45) Date of Patent: Oct. 25, 2011

(54) COUNTERBALANCE DEVICES FOR A CLOSURE

(75) Inventor: Robert Joseph Haeberle, New Bern, NC (US)

(73) Assignee: Electrolux Home Products, Inc., Cleveland, OH (US)

( * ) Notice: Subject to any disclaimer, the term of this patent is extended or adjusted under 35 U.S.C. 154(b) by 910 days.

(21) Appl. No.: 11/563,056

(22) Filed: Nov. 24, 2006

(65) Prior Publication Data

US 2008/0122331 A1 May 29, 2008

(51) Int. Cl.
*B08B 3/00* (2006.01)
*A47B 95/02* (2006.01)

(52) U.S. Cl. ..... 134/56 D; 134/57 D; 312/319.1; 312/319.4

(58) Field of Classification Search ..... None
See application file for complete search history.

(56) References Cited

U.S. PATENT DOCUMENTS

| | | | |
|---|---|---|---|
| 1,678,855 | A | 7/1928 | Forshee |
| 1,785,568 | A | 12/1930 | Wells |
| 1,963,388 | A | 6/1934 | Smith |
| 2,129,750 | A | 9/1938 | Schneider |
| 2,198,346 | A | 4/1940 | Little |
| 2,237,795 | A | 4/1941 | Shroyer |
| 2,550,161 | A | 4/1951 | Pearce |
| 2,553,439 | A | 5/1951 | Carmichael |
| 2,663,047 | A | 12/1953 | Grenzeback |
| 2,833,270 | A | 5/1958 | Brown et al. |
| 3,049,114 | A | 8/1962 | Carnahan et al. |
| 3,195,172 | A | 7/1965 | Gionet |
| 3,288,154 | A | 11/1966 | Jacobs |
| 3,466,105 | A | 9/1969 | Guth |
| 3,820,866 | A | 6/1974 | Kaldenberg |
| 3,837,119 | A | 9/1974 | Conneally et al. |
| 3,912,350 | A | 10/1975 | Gurubatham |
| 3,921,252 | A | 11/1975 | Guth |
| 3,978,617 | A | 9/1976 | Eventoff |
| 4,086,726 | A | 5/1978 | Moses |
| 4,163,344 | A | 8/1979 | Scherer |
| 4,853,985 | A | 8/1989 | Perry |
| 4,887,393 | A | 12/1989 | Cysewski |
| 4,898,493 | A | 2/1990 | Blankenburg |
| 4,900,109 | A | 2/1990 | Boston, Jr. et al. |
| 5,050,943 | A | 9/1991 | Barnett |
| 5,226,706 | A | 7/1993 | Tuller |
| 5,341,542 | A | 8/1994 | Hannan et al. |
| 5,373,665 | A | 12/1994 | Lyons, Sr. |
| 5,386,884 | A | 2/1995 | Chisholm |
| 5,452,184 | A | 9/1995 | Scholder et al. |
| 5,465,557 | A | 11/1995 | Harte |
| 5,546,632 | A | 8/1996 | Robinson et al. |
| 5,980,006 | A | 11/1999 | Wilhelmstatter et al. |
| 5,988,933 | A | 11/1999 | Wilhelmstatter et al. |
| 6,467,128 | B1 | 10/2002 | Damani |
| 6,505,381 | B1 | 1/2003 | Thomson et al. |
| 6,557,958 | B1 | 5/2003 | Motta et al. |
| 7,472,457 | B2 | 1/2009 | Giovannetti |
| 2004/0113531 | A1 | 6/2004 | Raches |
| 2005/0076938 | A1 | 4/2005 | Jordan et al. |
| 2008/0272678 | A1 | 11/2008 | Tynes et al. |

OTHER PUBLICATIONS

Office action dated Oct. 23, 2009 for U.S. Appl. No. 11/869,911.
Amendment dated Jan. 25, 2010 for U.S. Appl. No. 11/869,911.
Final Office action dated Mar. 17, 2010 for U.S. Appl. No. 11/869,911.
Amendment dated Aug. 17, 2010 for U.S. Appl. No. 11/869,911.

*Primary Examiner* — Michael Barr
*Assistant Examiner* — Jason Ko
(74) *Attorney, Agent, or Firm* — Alston & Bird LLP

(57) ABSTRACT

Counterbalance devices are provided for a closure mounted with respect to a container. The devices can include a stationary friction member, an elongated flexible member, and a biasing member. The stationary friction member can be comprised of a mounting portion and a friction portion. An intermediate portion of the elongated flexible member can also slidingly engage the friction surface of the stationary friction member.

20 Claims, 3 Drawing Sheets

100
15
20
13
16
12
200
60
18
24
28
1A
56b
34
40
56a
32
26
1A
10

36
14
38
22

COUNTERBALANCE DEVICES FOR A CLOSURE

FIELD OF THE INVENTION

The present invention relates to counterbalance devices. More specifically, the present invention relates to counterbalance devices for a closure.

BACKGROUND OF THE INVENTION

Pivoting door systems are known to include conventional counterbalance systems configured to facilitate pivoting of a door between an open and closed orientation. However, conventional counterbalance systems can result in an increase in material and assembly costs due to the complexity of these conventional systems. Moreover, conventional counterbalance systems may have undesirable wear characteristics over time.

Thus, there is a need for reliable counterbalance devices with reduced complexity and assembly costs.

SUMMARY OF THE INVENTION

It is an aspect of the present invention to obviate the problems and shortcomings of conventional counterbalance systems.

In accordance with one aspect, a counterbalance device is provided for a closure mounted with respect to a container. The device comprises a bracket, a frame, a stationary friction member, an elongated flexible member, and a biasing member. The bracket includes a lever arm and a mounting arm configured to mount a closure to the bracket. The frame is configured to support a container and the bracket is pivotally attached to the frame. The stationary friction member includes a mounting portion and a friction portion. The friction portion includes a friction surface and the mounting portion fixedly attaches the stationary friction member to the frame. The elongated flexible member includes a first end and a second end. The first end is configured to be attached with respect to the lever arm of the bracket and the second end is configured to be attached with respect to the frame. The biasing member is configured to place the elongated flexible member under tension. An intermediate portion of the elongated flexible member is configured to slidingly engage the friction surface while the friction portion remains stationary with respect to the frame.

In accordance with another aspect, an apparatus comprises a container including an opening, a closure, a stationary friction member, an elongated flexible member, and a biasing member. The closure is configured to selectively close the opening of the container. The stationary friction member includes a mounting portion and a friction portion. The friction portion includes a friction surface and the mounting portion is configured to fixedly attach the stationary friction member with respect to the container. The elongated flexible member includes a first end and a second end. The first end is configured to be attached with respect to the closure and the second end is configured to be attached with respect to the container. The biasing member is configured to place the elongated flexible member under tension. An intermediate portion of the elongated flexible member is configured to slidingly engage the friction surface while the friction portion remains stationary with respect to the container.

In accordance with still another aspect, a dishwasher apparatus comprises a wash tub, a dishwasher door, a frame, a bracket, a stationary friction member, an elongated flexible member, and a biasing member. The wash tub includes an opening into an interior area of the tub. The dishwasher door is configured to selectively close the opening of the wash tub. The frame is configured to support the wash tub. The bracket includes a lever arm and a mounting arm. The mounting arm is attached with respect to the dishwasher door and the bracket can be pivotally attached to the frame. The stationary friction member comprises a one-piece unitary structure with a mounting portion and a friction portion. The friction portion includes a channel including a friction surface that can extend along an arcuate path. The mounting portion is fixedly attached to the frame. The elongated flexible member includes a first end and a second end. The first end is attached with respect to the lever arm of the bracket. The biasing member is attached between the second end of the elongated flexible member and the frame and is configured to place the elongated flexible member under tension. An intermediate portion of the elongated flexible member is configured to slidingly engage the arcuate friction surface while the friction portion remains stationary with respect to the frame.

BRIEF DESCRIPTION OF THE DRAWINGS

The foregoing and other aspects of the present invention will become apparent to those skilled in the art to which the present invention relates upon reading the following description with reference to the accompanying drawings, in which.

DETAILED DESCRIPTION OF EXAMPLE EMBODIMENTS

Figure 1:
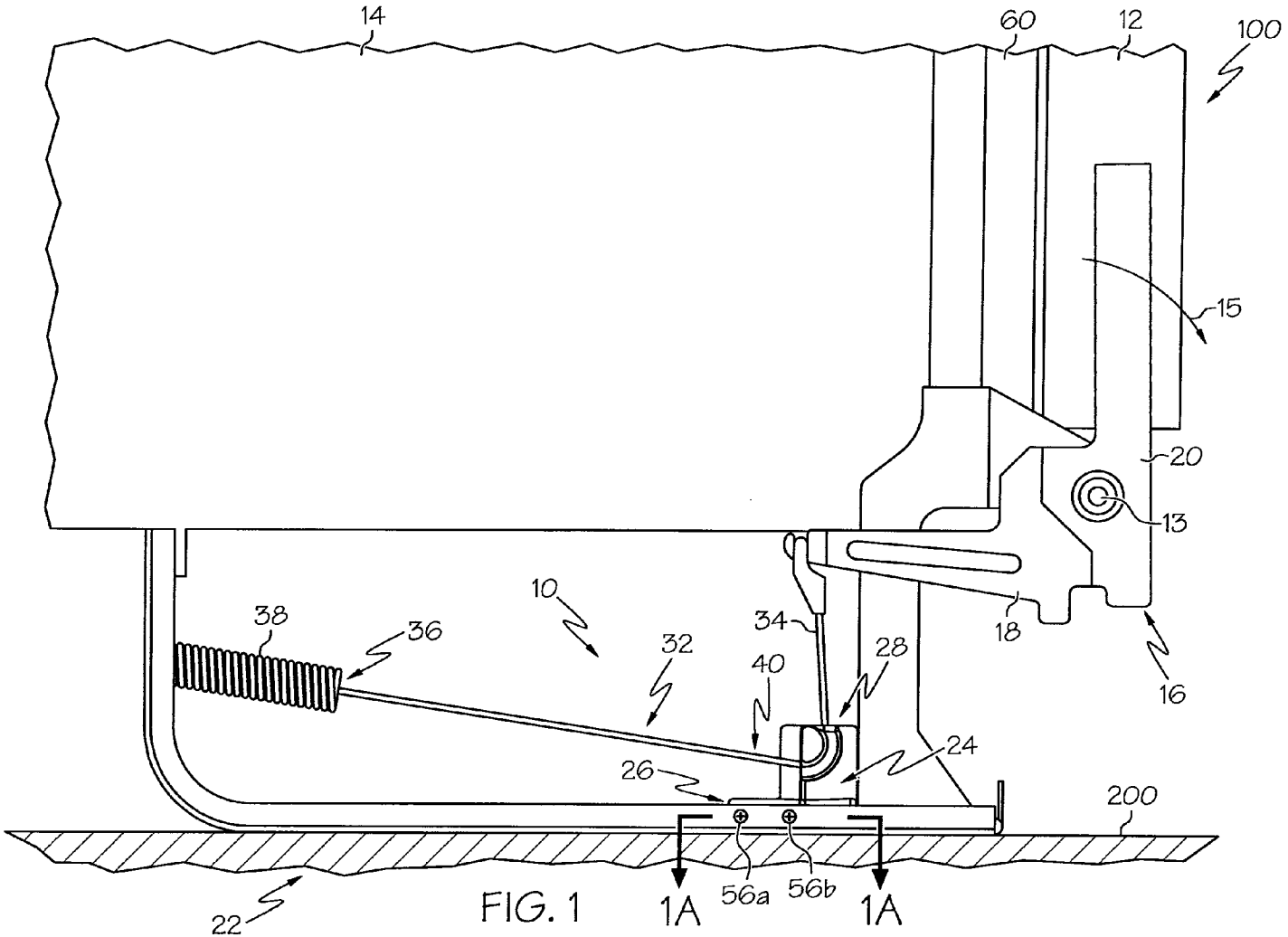
FIG. 1 is a side view of portions of an example dishwasher apparatus incorporating aspects of the present invention.

Certain terminology is used herein for convenience only and is not to be taken as a limitation on the present invention. Further, in the drawings, the same reference numerals are employed for designating the same elements.

Counterbalance devices in accordance with aspects of the present invention can be provided to facilitate pivoting of a closure between an open and closed orientation. For instance, example counterbalance devices can reduce the effort required to move the closure between an opened and/or closed orientation. In further examples, the counterbalance devices can reduce the tendency of the closure to slam to an open or closed orientation under the influence of gravity. In still further examples, counterbalance devices can be provided to allow a closure to substantially maintain a position between an open and closed orientation over a period of time. For instance, a user may orient the closure to a partially open orientation and then release the closure. After the user releases the closure, the partially open orientation of the closure with respect to the container may be maintained at the same position, substantially the same position, and/or substantially within a range including the position over a period of time.

It is to be appreciated that counterbalance devices incorporating aspects of the invention can be used in different types of containers including containers for appliances, such as refrigerators, washers, driers, dishwashers, ovens, or other types of containers. As shown in FIG. 1, one example of a counterbalance device 10 is illustrated for use with a closure 12 of a dishwasher apparatus 100. FIG. 1 illustrates portions of just one example of a dishwasher apparatus 100 that incorporates the illustrated example counterbalance device 10. As shown, the container 14 comprises the dishwasher tub and the closure 12 comprises a downwardly swinging door configured to selectively close a front opening 60 of the dishwasher tub. Although not shown, in addition or alternatively, the tub may be open from one or more of the rear, left side, right side top or other sides in further examples. In such examples, one or more counterbalance devices may be used with one or more of the additional and/or alternative openings. The tub can comprise thermoplastic material, stainless steel, aluminum, composite and/or other materials capable of withstanding the operating conditions of the dishwasher apparatus 100.

Example dishwasher apparatus 100 can include an optional frame 22 configured to support the container 14. As shown, the frame 22 can be configured to support the container 14 at an elevated position with respect to a support surface 200 to provide an area underneath the container 14. Such an area can be beneficial to provide room for the counterbalance device 10 and/or other components of the dishwasher apparatus 100. In addition, or alternatively, the frame 22 can also be configured to support the closure 12 relative to the container 14. In such examples, the frame 22 can be designed to withstand forces applied to it from the container 14 and/or closure 12 due to gravity and also during use of the dishwasher apparatus 100. The frame 22 can also be configured to facilitate use of the counterbalance device 10 to apply counterbalance forces to the closure 12. The frame 22, if provided, can be made of a wide variety of materials capable of supporting components of the dishwasher apparatus 100. For example, the frame 22 may be comprise of metal, plastic, ceramic, composite, and/or other material sufficient to provide support for the container 14 and/or closure 12.

The example counterbalance device 10 can also be used with different types of closures 12. For example, the closure 12 can be a top pivot door, front pivot door and/or a side pivot door to selectively close an opening of a container 14. In the illustrated example, the closure 12 comprises a front pivot door configured to pivot along the direction 15 about the pivot axis 13 between the closed position (shown in FIG. 1) to an open position (not shown). The closure 12 of the container 14 can also be provided with a gasket to facilitate closure and sealing of the closure with respect to the opening 60.

As shown in FIG. 1, a left side of the counterbalance device 10 is illustrated for cooperating with the left side of the closure 12. Although not shown, the counterbalance device 10 can include a right side that is a substantial mirror image of the left side. If provided, the right side of the counterbalance device can be mounted with respect to the right side of the closure 12. Providing a counterbalance device that acts on both the left and right sides can reduce torsion stresses that might otherwise develop at the pivot brackets. Example aspects of the left side of the counterbalance 10 will be described with the understanding that such description may substantially equally apply to the right side of the counterbalance device, if provided.

As shown, the example counterbalance device 10 can include a bracket 16 with a mounting arm 20. As shown in FIG. 1, the mounting arm 20 can be mounted to a left side portion of the closure 12 to permit pivoting of the closure 12 with respect to the container 14. The illustrated bracket 16 is pivotally attached to the frame 22 although the bracket may be pivotally attached directly to the container in further examples. The bracket 16 can be configured to allow the closure 12 to pivot along the direction 15 about the pivot axis 13 between the closed orientation (shown in FIG. 1) to an open orientation (not shown). It will be appreciated that the corresponding right side portion of the closure 12 can also be provided with a pivot bracket to reduce torsion stresses that might otherwise develop using a single pivot bracket. In examples where the counterbalance device 10 is provided to act at both the left and right side portion of the closure, the left and right brackets 16 can be substantial mirror images of one another.

Various configurations may be provided to permit the bracket 16 to pivot along the direction 15 about the pivot axis 13. In the illustrated example, a pivot joint is provided to permit relative pivoting of the bracket 16 with respect to the frame 22. Example pivot joints can include a common or separate pivot pin. The bracket can also be configured to limit the extent that the closure 12 may pivot to the open orientation. For example, the bracket may include a stop arm configured to interact with the frame 22 at a predetermined angular orientation between the bracket 16 and frame 22. In further examples, the bracket 16 or the frame 22 may include an arcuate slot with the other of the bracket and frame including a stop pin configured to travel within the arcuate slot to limit pivoting movement between the bracket and frame. Other configurations may also be provided to limit angular pivoting between the frame and bracket. Moreover, similar configurations may be provided between the bracket and tub in further examples. In the illustrated example, the bracket 16 is configured to permit the closure 12 to pivot approximately 90° between the fully closed orientation (shown in FIG. 1) to the fully open orientation (not shown) wherein the closure 12 extends substantially horizontal with respect to a support surface 200 to provide a horizontal support shelf for an extension rack.

If provided with two brackets, one or both of the brackets can include a lever arm. For example, as further illustrated in FIG. 1, the bracket 16 includes a lever arm 18 configured to engage a first end 34 of an elongated flexible member 32 of the counterbalance device 10. The bracket 16 can comprise various alternative materials. In the illustrated example, the bracket 16 comprises a metallic material although further brackets may comprise plastic, ceramic, composite, or other materials capable supporting the closure.

As shown in FIGS. 1-6, the counter balance device 10 further includes a stationary friction member 24. The stationary friction member 24 includes a mounting portion 26 configured to mount the stationary friction member with respect to the container 14. In the illustrated example, the mounting portion 26 is configured to be fixedly attached to the frame 22 although the mounting portion may be configured to fixedly attach the friction member to the container or other portions of the dishwasher apparatus 100 in further examples. A wide variety of mounting configurations may be provided for fixedly attaching the mounting portion 26 to the frame 22 and/or container 14. For example, snaps, an interlocking arrangement, rivets, adhesives or other mounting configurations may be used to fixedly attach the mounting portion 26 to the frame 22 and/or container 14. In further examples, the mounting portion 26 may be integrally formed with the frame 22 and/or container 14. For example, the mounting portion 26 may be welded (e.g., sonic welded, chemically welded, etc) to the frame 22 and/or container 14. In further examples, the mounting portion 26 or the entire friction member 24 may be injection molded or otherwise simultaneously formed with a portion of the frame and/or container.

Figure 1A:
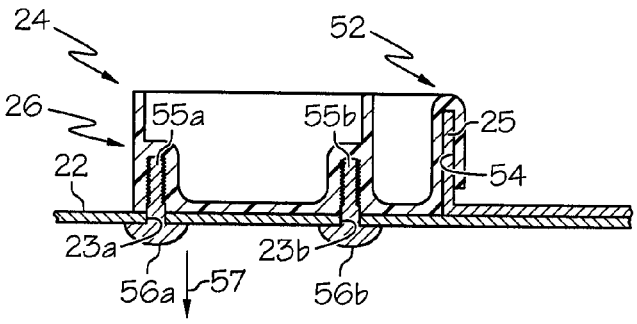
FIG. 1A is a sectional view of the example dishwasher along line 1A-1A of FIG. 1.
Figure 2:
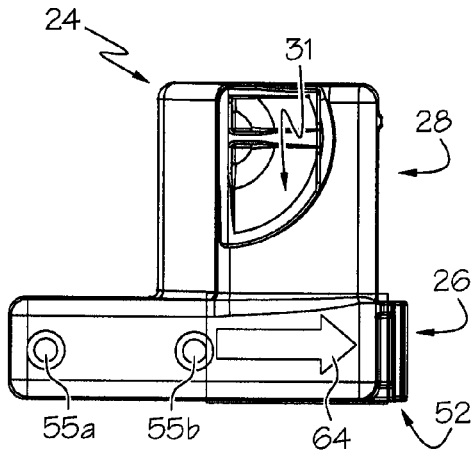
FIG. 2 is a front view of an example stationary friction member.

As illustrated in FIG. 1A, one example mounting configuration can provide the mounting portion 26 with first and second mounting apertures 55*a*, 55*b* that are open in a direction 57. Although a pair of apertures 55*a*, 55*b* are illustrated, it is contemplated that more or less than two mounting apertures may be provided in further examples. As shown in FIG. 1A, the mounting apertures 55*a*, 55*b* can be respectively aligned with apertures 23*a*, 23*b* of the frame 22 such that fasteners 56*a*, 56*b* may be inserted through the aligned apertures and tightened to fixedly attach the mounting portion 26 to the frame 22. Although not shown, a similar mounting configuration may be alternatively provided between the mounting portion and the container.

In further examples, the stationary friction member can include a locating device configured to provide proper alignment between the stationary friction member and the container and/or frame. As shown, for instance, the stationary friction member 24 can include a locating device 52 configured to engage the frame 22 to provide proper alignment between the stationary friction member 24 and the frame 22. The locating device 52 can comprise a wide variety of structural configurations. For example, the locating device can be an extension, protrusion, attachment, latch detent/dimple arrangement, or other structure configured to provide proper alignment. As shown in the illustrated example of FIG. 1A, the locating device 52 can comprise a channel 54 configured to receive a flange 25 of the frame 22 to provide proper alignment between the stationary friction member 24 and the frame 22. As further illustrated, the channel 54 can be open in the same direction 57 as the mounting apertures 55*a*, 55*b* to allow the stationary friction member to be inserted from behind a portion of the frame 22 to automatically align the mounting apertures 55*a*, 55*b* of the friction member 24 and corresponding apertures 23*a*, 23*b* of the frame 22.

In still further examples, the stationary friction member 24 may include indicia 64 for indicating the proper mounting orientation of the stationary friction member 24 with respect to the frame 22 and/or container 14. For example, as shown, the indicia 64 can comprise an arrow pointing towards the frame where the flange 25 of the frame 22 is to be received in the channel 54 of the locating device 52. The illustrated indica 64 is formed integrally with the stationary friction member 24, for example by a stamping or injection molding process. In further examples, the indicia may comprise an adhesive label, print, stenciling or other structure that is noticeable to one installing the stationary friction member. Furthermore, the indicia, if provided, may comprise shapes and/or symbols other than an arrow to indicate the proper orientation.

The stationary friction member 24 further includes a friction portion 28 with a friction surface 30. Example counterbalance devices can be arranged so that an intermediate portion 40 of the elongated flexible member 32 slidingly engages the friction surface 30 while the friction portion 28 remains stationary with respect to the frame and/or container. The friction surface 30 can include a wide range of shapes and/or configurations to permit sliding engagement with the intermediate portion 40 of the elongated flexible member 32. As shown in FIG. 3A for example, the friction surface can extend along an arcuate path 58 to facilitate a change in direction of portions of the elongated flexible member 32 as the intermediate portion 40 slides over the friction surface 30. As shown, the acuate path 58 can extend along an arc of at least about 90°. Thus, the arcuate path 58 can redirect a line of action of the spring force. In the illustrated example, the arcuate path 58 extends approximately 180°. Providing an arc path greater than 90° can facilitate a change of direction of the intermediate portion 40 of the flexible member 32 of greater than 90° as shown in FIG. 1. Moreover, as shown, the arc path can be greater than the change in direction of the flexible member to eliminate corners that might otherwise cause premature wear of the elongated flexible member 32. While the arc path is shown to be greater than 90°, it is contemplated that reduced angle paths may be provided in applications where the change in direction of the flexible member is less than 90°. It is to be appreciated that an arcuate path of the friction surface 58 can also be comprised of a plurality of straight edges, a combination of straight edges and arcs, or other shapes to provide frictional engagement between the intermediate portion 40 and the friction surface 30.

Figure 3:
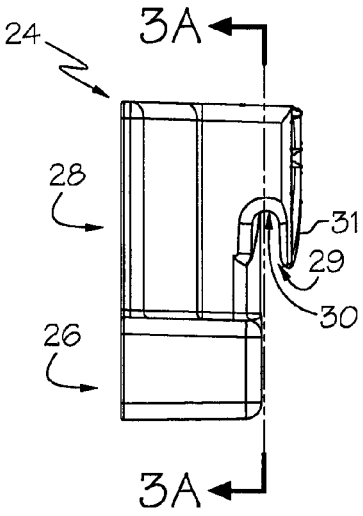
FIG. 3 is a left side view of the example stationary friction member of FIG. 2.
Figure 3A:
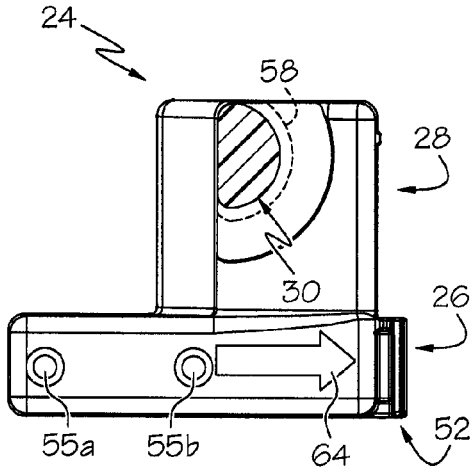
FIG. 3A is a sectional view of the example stationary friction member along line 3A-3A of FIG. 3.
Figure 4:
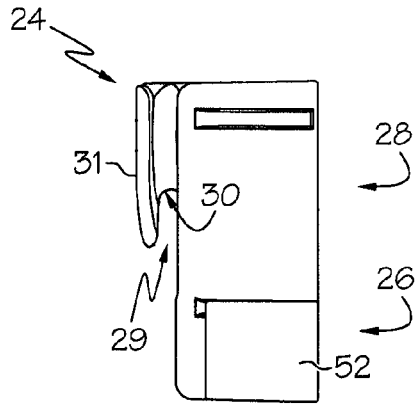
FIG. 4 is a right side view of the example stationary friction member of FIG. 2.
Figure 5:
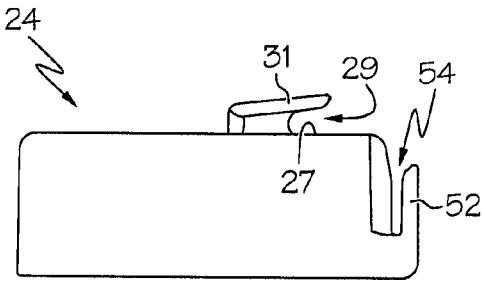
FIG. 5 is a bottom view of the example stationary friction member of FIG. 2.

As further best shown in FIGS. 3-5, the example friction portion 28 can also include an optional channel 29 including the friction surface 30. The channel 29 can be formed with an extension 31 extending along a side 27 of the friction portion 28. The extension 31 can be shaped to guide the intermediate portion 40 of the elongated flexible member 32 as it slides along the friction surface 30. Moreover, as shown in FIG. 5, portions of the extension 31 can be flared outward to facilitate reception of the intermediate portion 40. Furthermore, as shown in FIG. 4, further portions of the extension 31 can be shaped to extend substantially parallel or slightly inward with respect to the side 27 to guide the intermediate portion 40 around the arcuate path 58 and/or maintain the intermediate portion 40 against the friction surface 30. The friction surface 30 can be designed to be located substantially entirely along the bottom of the channel 29. In further examples, the friction surface 30 may be designed to extend along a substantial U-shape including the bottom of the channel 29, portions of the extension 31 and portions of the opposed side of the side 27 of the friction portion 28. It is to be appreciated that other shapes and extensions on different locations of the stationary friction member 24 may be used to form the friction channel 29. It is also to be appreciated that the friction channel 29 can be formed without the friction extension 31 in further examples.

Figure 6:
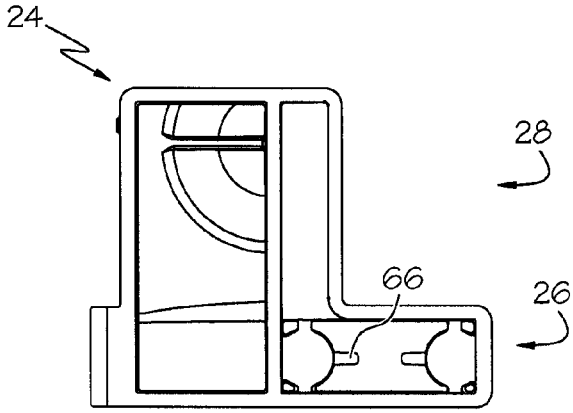
FIG. 6 is a rear view of the example stationary friction member of FIG. 2.

FIG. 6 shows a rear view of the stationary friction member 24. As shown, the rear portion includes open areas to allow the stationary friction member to have reduced material requirements and also provides portions of the stationary friction member 24 with thicknesses that can facilitate an injection molding process. Furthermore, as shown, example embodiments of the stationary friction member 24 can include screw boss supports 66 for further structural support of the mounting apertures 56.

Example stationary friction members may be formed from a wide range of process techniques to provide a desirable stationary friction member configuration. For instance, as shown in the figures, the stationary friction member 24 is configured with the mounting portion 26 and the friction portion 28 being integrally formed together as a unitary structure. A wide variety of manufacturing techniques may be used if the stationary friction member 24 is formed as a unitary structure. For example, the unitary structure of the stationary friction member 24 can be achieved by manufacturing the mounting portion 26 and the friction portion 28 from a one piece injection molding process, from a sonic welded process, from an adhesive attachment process, or other similar manufacturing processes. Although not shown, the mounting portion and the friction portion may also be formed as a nonunitary structure in further examples. For example, the mounting portion and friction portion may be mechanically fastened together, interlocked together or otherwise attached to one another in a nonunitary fashion.

Portions of the stationary friction member 24 may be formed from one or more types of materials. For instance, the mounting portion 26 may be formed from one type of material while the friction portion 28 is formed from another type of material. As shown, further examples of the stationary friction member 24 can form the entire stationary friction member from a single type of material. Various material types may be used in different example stationary friction members 24. For instance, the illustrated stationary friction member comprises an acetal copolymer material, though other materials may also be used. For example, it will be appreciated that one or more portions of the stationary friction member may be formed from other materials that can provide desirable wear characteristics and a friction surface having a desirable coefficient of friction. In further examples, the friction surface may be formed as a layer of material applied over a surface of the stationary friction member 24. The stationary friction member 24

The elongated flexible member 32 can comprise a wide range of materials such that the intermediate portion 40 of the flexible member 32 can flex around the friction surface 30 of the stationary friction member 24 while providing desirable frictional resistance and wear characteristics. In one example, the intermediate portion 40 can comprise a 0.125 inch diameter nylon although other synthetic materials, composite materials, metal, fabric or the like may be used in further examples. Moreover, as shown, the intermediate portion 40 comprises a cord such as a cable. In further examples, a string, rope, wire, thread or other elongated flexible member may be employed.

As seen in FIG. 1, the elongated flexible member 32 includes a first end 34 and a second end 36 connected to the intermediate portion 40. The first end 34 is configured to be attached with respect to the lever arm 18 of the bracket 16 and the second end 36 is configured to be attached with respect to the frame 22 and/or container 14. The first and second ends 34, 36 can include overmold connectors configured to permit the ends 34, 36 to be connected with respect to the lever arm 18, frame 22 and/or container 14. In one example, the elongated flexible member 32 can be designed to withstand at 50 pound pull without the intermediate portion 40 breaking or the intermediate portion 40 pulling free of the overmold connectors. In further examples, the elongated flexible member 32 can be designed with greater or less than 50 pound pull depending on the particular application requirements.

Counterbalance devices 10 can further include a biasing member 38 configured to place the elongated flexible member 32 under tension. In one embodiment, the biasing member 38 can attach the second end 36 of the elongated flexible member 32 to the frame 22. In addition or alternatively, the biasing member can be provided to attach the first end 34 of the elongated flexible member 32 to the lever arm 18 of the bracket 16. Still further, it is contemplated that the intermediate portion 40 of the elongated flexible member 32 may be provided with the biasing member in further examples. The biasing member can comprise a wide range of configurations in accordance with example counterbalance devices. In the illustrated example, the biasing member 38 comprises a coil spring although other springs may be used such as leaf springs, gas springs or other spring devices. In further examples, the biasing member may comprise a body of elastic material, such as an elastic cord.

Methods of assembling a dishwasher apparatus 100 with the counterbalance device 10 will now be described with the understanding that the steps of assembly can occur an various alternative orders in different examples. In one example, the container 14 is attached to the frame 22 such that the container is supported at an elevation above the underlying support surface 200. The closure 12 can then be pivotally mounted with respect to the frame by way of brackets 16. An appropriate stationary friction member 24 can then be selected. The installer can then use the indicia 64, if provided, to indicate the proper mounting orientation of the stationary friction member 24 with respect to the frame 22. The channel 54 of the locating device 52 can then be aligned with the flange 25 of the frame 22. The stationary friction member 24 can then be moved in the direction 57 such that the flange 25 is received within the channel 54 of the locating device 52. Once received, the apertures 55*a*, 55*b* are automatically aligned with corresponding apertures 23*a*, 23*b* in the frame 22. Next, the first fastener 56*a* is inserted through the first aperture 23*a* of the frame 22 and threaded into the first aperture 55*a* of the stationary friction member 24. Likewise, the second fastener 56*b* is inserted through the second aperture 23*b* of the frame 22 and threaded into the second aperture 55*b* of the stationary friction member 24. The fasteners 56*a*, 56*b* are then tightened such that the mounting portion 26 of the stationary friction member 24 fixedly attaches the stationary friction member 24 to the frame 22. The first end 34 of the elongated flexible member 32 can be attached to the lever arm 18 of the bracket 16. The biasing member 38 can then be used to attach the second end 36 of the elongated flexible member 32 to the frame 22. The intermediate portion 40 of the elongated flexible member 32 can then be pulled, against the force of the biasing member 38, over the extension 31 such that a portion of the intermediate portion 40 extends through the channel 29 of the stationary friction member 24. Once the intermediate portion 40 is within the channel 29, the individual assembling the counterbalance device 10 can release the intermediate portion 40 such that the biasing member pulls the intermediate portion into engagement with the friction surface 30 of the stationary friction member 32 and places the intermediate portion 40 under tension. The tension within the intermediate portion 40 pulls the intermediate portion 40 into frictional engagement with the friction surface 30 and further provides a counterbalance force to an end of the lever arm 18 to act as a counterbalance moment about the pivot axis 13.

In operation, movement of the closure 12 between the open and closed orientations causes the pivot bracket 16 and corresponding mounting portion 18 to pivot about the pivot axis 13. Rotational movement of the mounting portion 18 causes the first end 34 of the elongated flexible member 32 to move the intermediate portion 40 along the arcuate path 58 within the channel 54 of the stationary friction member 24. Indeed, during movement of closure 12 from the closed position illustrated in FIG. 1, to the open position, the mounting portion 18 of the bracket 16 will pivot in a clockwise direction about the pivot axis 13 (as shown in the position of FIG. 1). Clockwise pivoting of the mounting portion 18 will pull the intermediate portion 40 through the channel 54 of the stationary friction member 24 in a first direction against the force of the biasing member 38. On the other hand, movement of the closure from the open position (not shown) to the closed position illustrated in FIG. 1, the mounting portion 18 of the bracket 16 will pivot in a counterclockwise direction about the pivot axis 13 (as shown in the position of FIG. 1). The counterclockwise pivoting of the mounting portion 18 will allow the biasing member 38 to pull the intermediate portion through the channel in a second direction opposed to the first direction. Movement of the intermediate portion 40 within the channel 54 of the stationary friction member 24 results in a frictional resistance force created between the intermediate portion 40 and the friction surface 30 as the intermediate portion slides over the friction surface 30 along the arcuate path 58. If a user releases the closure 12 somewhere between the open and closed orientation, the interaction between the intermediate portion 40 and the friction surface 30 together with the force imposed by the biasing member 38 can provide a moment about the pivot axis 13 that counters the moment about the pivot axis 13 caused by the weight of the closure 12. Moreover, such interaction between the intermediate portion 40 and the friction surface 30 can assist in substantially maintaining a position of the closure 12 between the open and closed orientation over a period of time. In addition, or alternatively, the interaction between the intermediate portion 40 and the friction surface 30 can help prevent the closure 12 from slamming into a fully open orientation if the closure 12 is released between the open and closed orientation.

From the above description of the invention, those skilled in the art will perceive improvements, changes, and modifications. Such improvements, changes, and modifications within the skill of the art are intended to be covered by the appended claims.

What is claimed is:

1. An apparatus comprising:

a container including an opening;

a closure configured to selectively close the opening of the container;

a stationary friction member including a mounting portion and a friction channel with a bottom portion and opposed sides, wherein the friction channel includes a friction surface located within a depth of the friction channel, the friction surface being defined by at least the bottom portion of the friction channel, and the mounting portion is configured to fixedly attach the stationary friction member with respect to the container such that the entire friction member, including the friction channel, is nonrotatable with respect to the container;

an elongated flexible member including a first end and a second end, wherein the first end is configured to be attached with respect to the closure and the second end is configured to be attached with respect to the container; and a biasing member configured to place the elongated flexible member under tension, wherein an intermediate portion of the elongated flexible member is configured to slidingly engage the bottom portion of the friction channel defining the friction surface while the friction channel remains stationary with respect to the container and the mounting portion of the stationary friction member, wherein a transverse cross section of the intermediate portion has a height that is less than the depth of the friction channel such that the intermediate portion is located entirely within the depth of the friction channel while engaging the bottom portion of the friction channel, wherein the intermediate portion is configured to slide relative to the bottom portion of the friction channel to create a frictional resistance force that acts as a counterbalance for the closure pivoting between an open orientation and a closed orientation with respect to the opening of the container, a frame supporting the container, wherein a bracket pivotally attaches the closure to the frame and wherein the second end of the elongated flexible member is configured to be attached with respect to the frame, and wherein the stationary friction member includes a locating device configured to engage the frame to provide a proper alignment between the stationary friction member and the frame, and wherein the locating device comprises a channel and the frame includes a flange configured to be received in the channel such that at least one aperture defined in the friction member aligns with at least one aperture defined in the frame.

2. The apparatus of claim 1, further comprising a bracket including a lever arm and a mounting arm, wherein the mounting arm is attached to the closure and the lever arm attaches the first end of the elongated flexible member to the closure.

3. The apparatus of claim 1, wherein the stationary friction member is formed as a one-piece injection molded unitary structure.

4. The apparatus of claim 3, wherein the stationary friction member is formed from an acetal copolymer material.

5. The apparatus of claim 1, wherein the stationary friction member includes indicia for indicating the proper mounting orientation of the stationary friction member with respect to the frame.

6. The apparatus of claim 1, wherein the stationary friction member includes at least one mounting aperture open in a direction and wherein the channel is open in the same direction as the mounting aperture.

7. The apparatus of claim 1, wherein the biasing member attaches the second end of the elongated flexible member to the frame.

8. The apparatus of claim 1, wherein the mounting portion and the friction channel are integrally formed together as a one-piece unitary structure.

9. The apparatus of claim 1, wherein the stationary friction member is formed from an acetal copolymer material.

10. The apparatus of claim 1, wherein the friction surface extends along an arcuate path.

11. The apparatus of claim 1, wherein the arcuate path extends along an arc of at least about 90°.

12. The apparatus of claim 1, wherein the apparatus is a dishwasher, and the container is a wash tub.

13. An apparatus comprising:

a container including an opening;

a closure configured to selectively close the opening of the container;

a stationary friction member including a mounting portion and a friction portion that are integrally formed together as a one-piece unitary structure, wherein the friction portion includes a friction surface and the mounting portion is configured to fixedly attach the stationary friction member with respect to the container such that the entire friction member, including the friction portion, is nonrotatable with respect to the container;

an elongated flexible member including a first end and a second end, wherein the first end is configured to be attached with respect to the closure and the second end is configured to be attached with respect to the container;

a biasing member configured to place the elongated flexible member under tension, wherein an intermediate portion of the elongated flexible member is configured to slidingly engage the friction surface while the friction portion remains stationary with respect to the container and the mounting portion of the stationary friction member; and a frame supporting the container, wherein the stationary friction member is stationary with respect to the frame and includes a locating device configured to engage the frame to provide a proper alignment between the stationary friction member and the frame, and wherein the locating device comprises a channel and the frame includes a flange configured to be received in the channel, such that at least one aperture defined in the friction member aligns with at least one aperture defined in the frame.

14. An apparatus comprising:

a container including an opening;

a closure configured to selectively close the opening of the container;

a stationary friction member comprising a mounting portion and a friction channel that are integrally formed together as a one-piece unitary structure, wherein the friction channel includes a friction surface located within a depth of the friction channel, the friction surface being defined by a bottom portion and opposed sides of the friction channel, and the mounting portion is configured to fixedly attach the stationary friction member with respect to the container such that the one-piece unitary structure is fixedly positioned with respect to the container and the entire friction member, including the friction portion, is not movable with respect to the container;

an elongated flexible member including a first end and a second end, wherein the first end is configured to be attached with respect to the closure and the second end is configured to be attached with respect to the container; and a biasing member configured to place the elongated flexible member under tension, wherein an intermediate portion of the elongated flexible member is configured to slidingly engage the bottom portion and opposed sides of the friction channel defining the friction surface while the friction portion remains stationary with respect to the container and the mounting portion of the stationary friction member, and a transverse cross section of the intermediate portion has a height that is less than the depth of the friction channel such that the intermediate portion is located entirely within the depth of the friction channel while engaging the opposed sides and the bottom portion of the friction channel, wherein the intermediate portion of the elongated flexible member is configured to slide against the opposed sides and the bottom portion of the channel defining the friction surface to create a frictional resistance force that acts as a counterbalance for the closure pivoting between an open orientation and a closed orientation with respect to the opening of the container, a frame supporting the container, wherein the stationary friction member is stationary with respect to the frame and includes a locating device configured to engage the frame to provide a proper alignment between the stationary friction member and the frame, and wherein the locating device comprises a channel and the frame includes a flange configured to be received in the channel such that at least one aperture defined in the friction member aligns with at least one aperture defined in the frame.

15. The apparatus of claim 1, wherein the friction member comprises a main housing fixed to the container and an extension spaced outwardly therefrom, wherein the bottom portion of the channel extends between the main housing and the extension such that one opposed side of the channel is defined by the extension and the other opposed side of the channel is defined by the main housing.

16. The apparatus of claim 15, wherein the extension is flared outwardly with respect to the main housing to facilitate reception of the intermediate portion into the channel.

17. The apparatus of claim 1, wherein the friction surface is further defined by the opposed sides of the friction channel, the intermediate portion is located entirely within the depth of the friction channel while engaging the opposed sides and the bottom portion of the friction channel, and the frictional resistance force is created by sliding the intermediate portion of the elongated flexible member against the opposed sides and the bottom portion of the channel defining the friction surface.

18. The apparatus of claim 15, wherein the extension extends inward with respect to the main housing to guide the intermediate portion within the channel.

19. The apparatus of claim 1, wherein the friction channel is spaced laterally outward from the container such that one opposed side of the channel is spaced further away from the container than the other opposed side.

20. The apparatus of claim 14, wherein the arcuate path extends along an arc of about 180°.

* * * * *